US010702015B2

(12) United States Patent
Craig et al.

(10) Patent No.: US 10,702,015 B2
(45) Date of Patent: Jul. 7, 2020

(54) ARTICLE OF APPAREL WITH ZONAL FORCE ATTENUATION PROPERTIES

(71) Applicant: NIKE, Inc., Beaverton, OR (US)

(72) Inventors: Kenneth T. Craig, Beaverton, OR (US); Hagit Ottens-Wilk, Beaverton, OR (US); Donna L. Marchant, Hertfordshire (GB)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 16/408,627

(22) Filed: May 10, 2019

(65) Prior Publication Data

US 2019/0261738 A1 Aug. 29, 2019

Related U.S. Application Data

(60) Continuation of application No. 15/169,918, filed on Jun. 1, 2016, now Pat. No. 10,327,505, which is a division of application No. 11/262,323, filed on Oct. 28, 2005, now Pat. No. 9,380,831.

(51) Int. Cl.

| | |
|---|---|
| ***A43B 13/18*** | (2006.01) |
| ***A43B 7/14*** | (2006.01) |
| ***A41B 11/02*** | (2006.01) |
| ***A43B 23/07*** | (2006.01) |

(52) U.S. Cl.

CPC ..... *A43B 13/188* (2013.01); *A41B 11/02* (2013.01); *A43B 7/142* (2013.01); *A43B 7/143* (2013.01); *A43B 7/144* (2013.01); *A43B 7/1415* (2013.01); *A43B 7/1425* (2013.01); *A43B 23/07* (2013.01)

(58) Field of Classification Search

None

See application file for complete search history.

(56) References Cited

U.S. PATENT DOCUMENTS

| | | | |
|---|---|---|---|
| 2,001,293 | A | 5/1935 | Wilson |
| 3,793,851 | A | 2/1974 | Thorneburg |
| 4,194,249 | A | 3/1980 | Thorneburg |
| 4,253,317 | A | 3/1981 | Howard et al. |
| 4,255,949 | A | 3/1981 | Thorneburg |
| 4,277,959 | A | 7/1981 | Thorneburg |
| 4,373,215 | A | 2/1983 | Guigley |
| 4,373,361 | A | 2/1983 | Thorneburg |
| 4,520,635 | A | 6/1985 | Shields et al. |
| 4,732,015 | A | 3/1988 | Abrams et al. |

(Continued)

OTHER PUBLICATIONS

Three photographs of Kayano Low Cute Socks, Manufactured by Asics.

(Continued)

*Primary Examiner* — Tung S Lau

(74) *Attorney, Agent, or Firm* — Banner & Witcoff, Ltd.

(57) ABSTRACT

An article of apparel, such as a sock or a shoe, is disclosed as having a foot-supporting area for extending adjacent to a plantar surface of a foot. The foot-supporting area has various zones of differing thickness that attenuate forces upon the plantar surface to different degrees. The apparel may be manufactured through a process that includes utilizing a force mapping device to obtain data relating to forces upon the plantar surface of the foot. The sock is then formed to have zones of different thickness located to correspond with the areas of the plantar surface subjected to different magnitudes of forces.

11 Claims, 10 Drawing Sheets

(56) References Cited

U.S. PATENT DOCUMENTS

| | | | | |
|---|---|---|---|---|
| 5,014,706 | A | 5/1991 | Philipp | |
| 5,103,656 | A * | 4/1992 | Hanson, II | A41B 11/003 2/239 |
| 5,307,522 | A | 5/1994 | Throneburg et al. | |
| 5,335,517 | A | 8/1994 | Throneburg et al. | |
| 5,560,226 | A | 10/1996 | Throneburg | |
| 5,603,232 | A | 2/1997 | Throneburg | |
| 5,771,495 | A | 6/1998 | Turner et al. | |
| 5,791,163 | A | 8/1998 | Throneburg | |
| 6,021,527 | A | 2/2000 | Lessard | |
| 6,176,025 | B1 | 1/2001 | Patterson et al. | |
| 6,178,785 | B1 * | 1/2001 | Samata | D04B 1/26 2/239 |
| 6,286,151 | B1 | 9/2001 | Lambertz | |
| 6,324,874 | B2 | 12/2001 | Fujimoto | |
| 6,510,626 | B1 | 1/2003 | Greenawalt | |
| 6,789,333 | B2 | 9/2004 | Nishiwaki et al. | |
| 7,051,457 | B1 | 5/2006 | Huggins et al. | |
| 7,210,250 | B2 | 5/2007 | Gallegos | |
| 7,484,319 | B2 | 2/2009 | Cheskin et al. | |
| 8,959,959 | B1 * | 2/2015 | Podhajny | D04B 1/16 66/177 |
| 2007/0094892 | A1 | 5/2007 | Craig et al. | |
| 2008/0034479 | A1 * | 2/2008 | Barnett | A41B 11/02 2/241 |
| 2013/0137943 | A1 | 5/2013 | Pinto Rodrigues | |
| 2013/0192071 | A1 | 8/2013 | Esposito et al. | |
| 2014/0196308 | A1 | 7/2014 | Baratta et al. | |
| 2014/0317833 | A1 | 10/2014 | Craig et al. | |
| 2015/0059209 | A1 * | 3/2015 | Dekovic | A43B 23/0275 36/84 |
| 2016/0081435 | A1 | 3/2016 | Marks | |

OTHER PUBLICATIONS

Internet Pubhcation for "X-Socks" Product, downloaded May 3, 2005 from http://www.x-socks.com.

Coates, et al. "Wearable Multimodal Skin Sensing for the Diabetic Foot". Electronics, 2016, 5, 45; doi:10.3390/electronics5030045, pp. 1-14.

Hodgson, Michael. "Custom Insoles Mold to Foot and Shoe". The Spokesman-Review, Mar. 17, 1996.

Mistry, Taresh D. "Design Feasibility of an Active Ankle-Foot Stabilizer" University of Waterloo, Ontario, CA. 2010.

Hedge et al. "A Comparative Review of Footwear-Based Wearable Systems". Electronics, 2016, 5, 48; doi:10.3390/electronics5030048, pp. 1-28.

Razak et al. "Foot Plantar Pressure Measurement System: A Review" Sensors 2012, 12, p. 9884-9912; doi:10.3390/s120709884.

* cited by examiner

ARTICLE OF APPAREL WITH ZONAL FORCE ATTENUATION PROPERTIES

RELATED APPLICATIONS

This application is a continuation application of application Ser. No. 15/169,918, filed on Jun. 1, 2016, which is a divisional application of application Ser. No. 11/262,323, filed on Oct. 28, 2005, now U.S. Pat. No. 9,380,831, each of which is incorporated herein by reference in its entirety.

BACKGROUND

A foot may experience significant forces during walking, running, and other ambulatory activities. During running, for example, the motion of the foot generally proceeds as follows: Initially, a heel region of the foot strikes the ground, followed sequentially by an arch region and a forefoot region of the foot. As the heel region leaves the ground, the foot rolls forward so that the forefoot region, including the toes, makes contact with the ground. Finally, the entire foot leaves the ground to begin another cycle. During the time that the foot is in contact with the ground, the foot typically rolls from the outside (i.e., lateral side) to the inside (i.e., medial side), a process called pronation. That is, normally, the outside of the heel region strikes the ground first, and the toes on the inside of the foot leave the ground last.

Supporting the weight of the individual, imparting balance to the individual, and flexing to accommodate the motion of the foot discussed above may induce bending, tensile, and compressive forces in the various bones, muscles, ligaments, and tendons associated with the foot. Compressing a plantar surface (i.e., lower surface) of the foot against the ground or the interior of an article of footwear also induces compressive forces in the plantar surface. A magnitude of the compressive forces experienced by the plantar surface of the foot varies throughout the plantar surface. That is, some areas of the plantar surface experience forces with a relatively high magnitude, while other areas of the plantar surface experience forces with a relatively low magnitude.

An article of athletic footwear generally incorporates a sole structure with a polymer foam material that attenuates forces experienced by the foot. Fluid-filled bladders, for example, may be encapsulated within the polymer foam material to further assist with force attenuation, and moderators may be incorporated into the sole structure to distribute forces with a higher magnitude over a greater area of the plantar surface, thereby decreasing the peak forces experienced by an area of the plantar surface. Despite these footwear elements, however, the compressive forces experienced by the foot continue to vary throughout the plantar surface.

SUMMARY

An aspect of the present invention is an article of apparel, such as a sock or shoe, that has varying force attenuation properties in portions corresponding with a plantar surface of a foot. The varying force attenuation properties may be formed through areas of different thickness in the apparel, and the varying force attenuation properties may be located in various zones that correspond with areas of different compressive forces experienced by the foot during ambulatory activities.

One aspect of the invention is an article of apparel having a foot-supporting area for extending adjacent to a plantar surface of a foot. The foot-supporting area has a forefoot region, an arch region, and a heel region. The forefoot region has a first zone positioned on a medial side of the foot-supporting area, and the first zone has a first thickness. The arch region has (a) a second zone positioned on a lateral side of the foot-supporting area, the second zone having a second thickness that is less than the first thickness and (b) a third zone positioned on the medial side of the foot-supporting area, the third zone having a third thickness that is less than the second thickness. The heel region has a fourth zone positioned on at least the lateral side of the foot-supporting area, the fourth zone having the first thickness.

In another aspect of the invention, the foot-supporting area has a first zone, a second zone, and a third zone. The first zone has an L-shaped configuration and corresponds in location with a position of a first proximal phalanx and at least first through third metacarpo-phalangeal joints of the foot. In addition, the first zone has a first thickness. The second zone corresponds in location with a calcaneus of the foot, and the second zone has the first thickness. The third zone corresponds in location with areas not corresponding with the first zone and the second zone, and the third zone has at least one thickness that is less than the first thickness.

Yet another aspect of the invention is a method of manufacturing a sock for receiving a foot. The method includes a step of utilizing a force mapping device to obtain data relating to forces upon a plantar surface of the foot during an ambulatory cycle. The data is analyzed to determine areas of the plantar surface subjected to forces above a threshold value during the ambulatory cycle. The sock is then formed to have zones of different thickness. One of the zones of different thickness is located to correspond with the areas of the plantar surface subjected to the forces above the threshold value.

In a further aspect of the invention a method of manufacturing a sock includes steps of (a) forming a heel zone of the sock with a circular knitting machine in a reciprocating mode, (b) forming a midfoot zone of the sock with the circular knitting machine in a circular mode, and (c) forming a forefoot zone of the sock with the circular knitting machine in the reciprocating mode. At least one of the heel zone and the forefoot zone include a first area that is thicker than a second area, and the first area and the second area are formed with the circular knitting machine in the reciprocating mode.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

DESCRIPTION OF THE DRAWINGS

The foregoing Summary, as well as the following Detailed Description, will be better understood when read in conjunction with the accompanying drawings.

DETAILED DESCRIPTION

Figure 1:
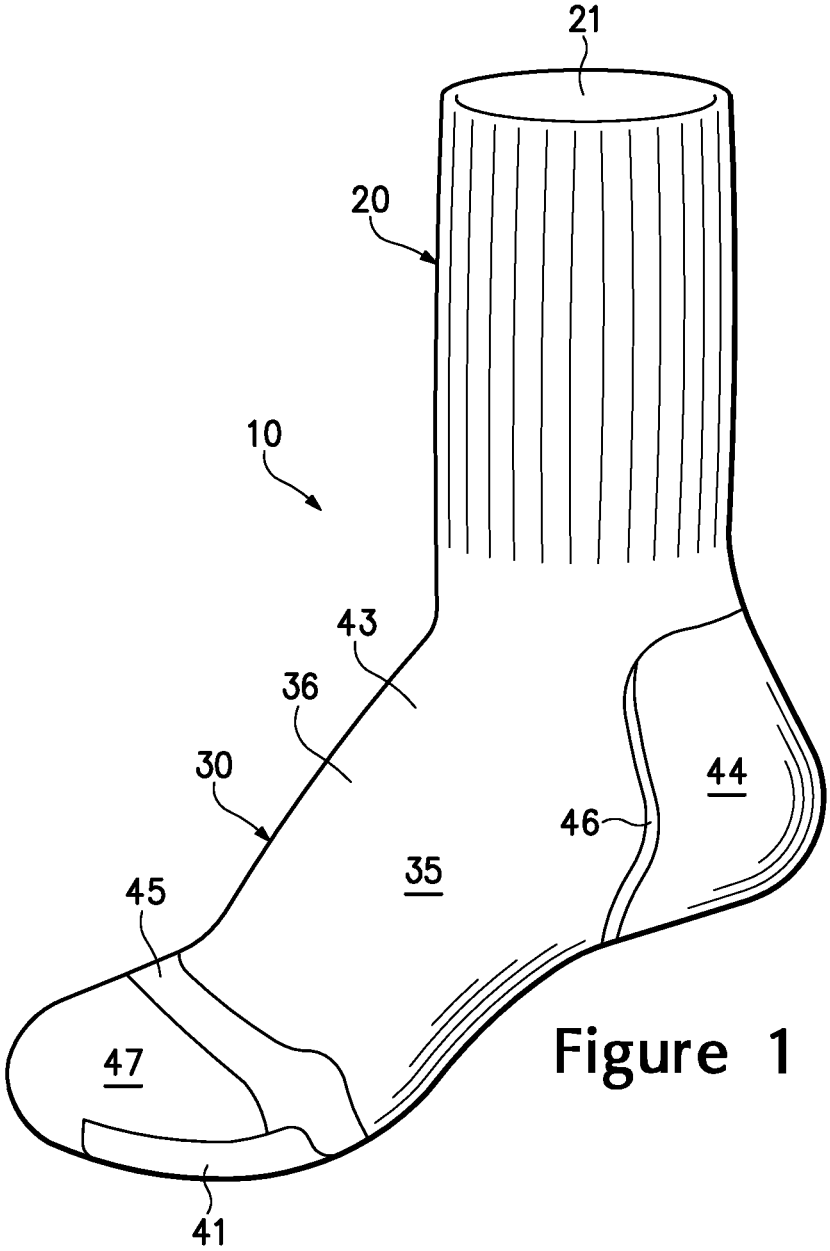
FIG. 1 is a perspective view of an article of apparel in accordance with aspects of the invention.
Figure 2:
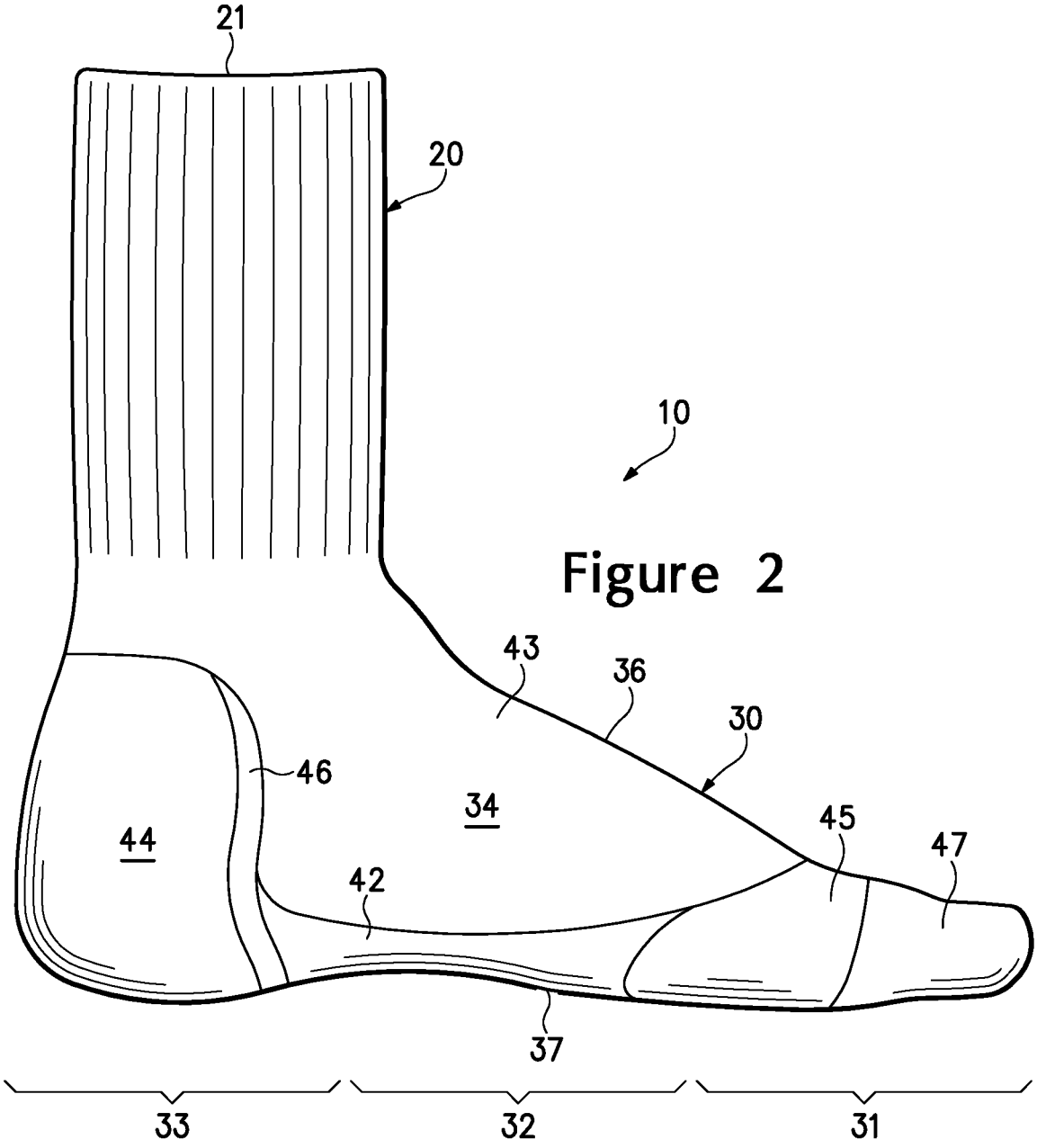
FIG. 2 is a first side elevational view of the article of apparel.
Figure 3:
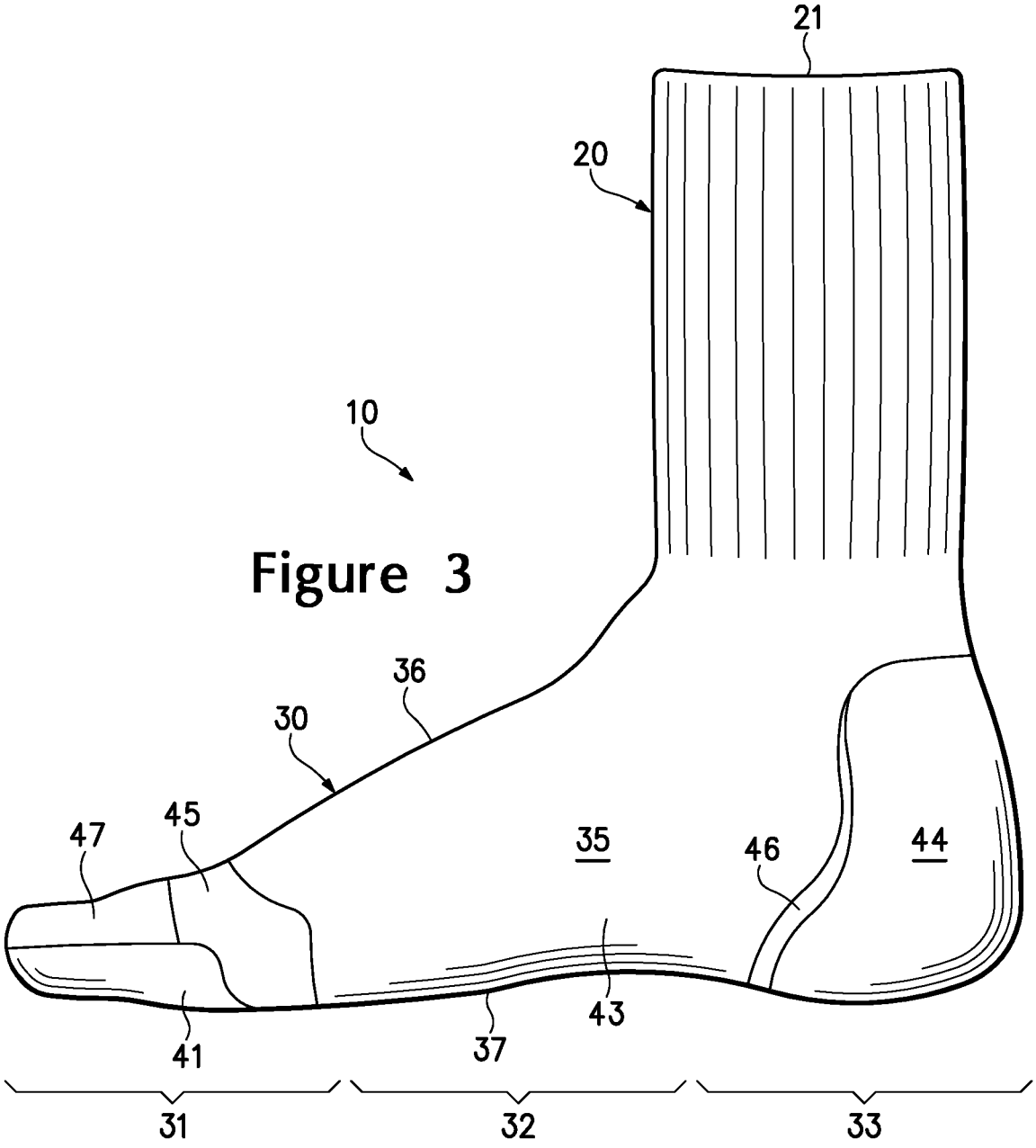
FIG. 3 is a second side elevational view of the article of apparel.
Figure 4:
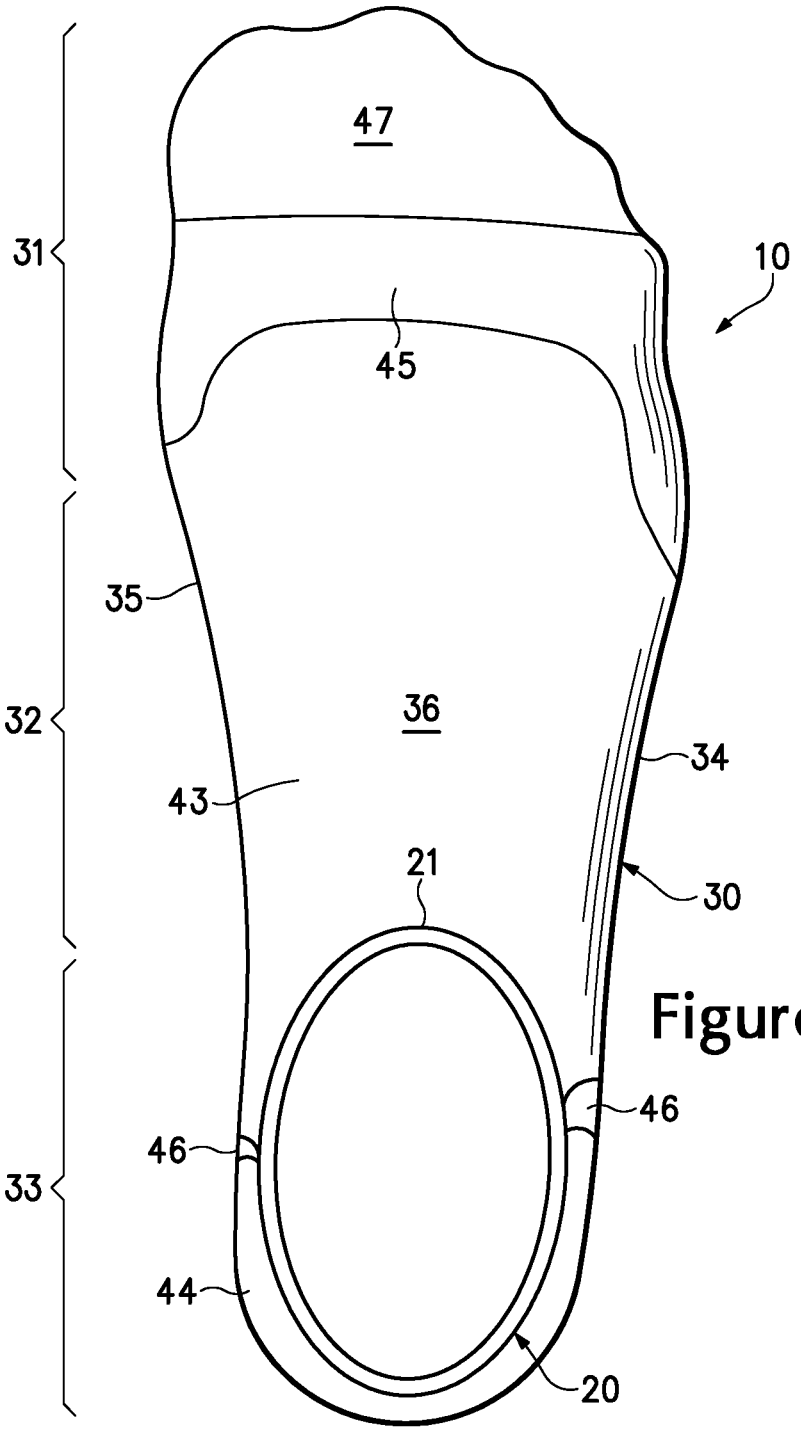
FIG. 4 is a top plan view of the article of apparel.
Figure 5:
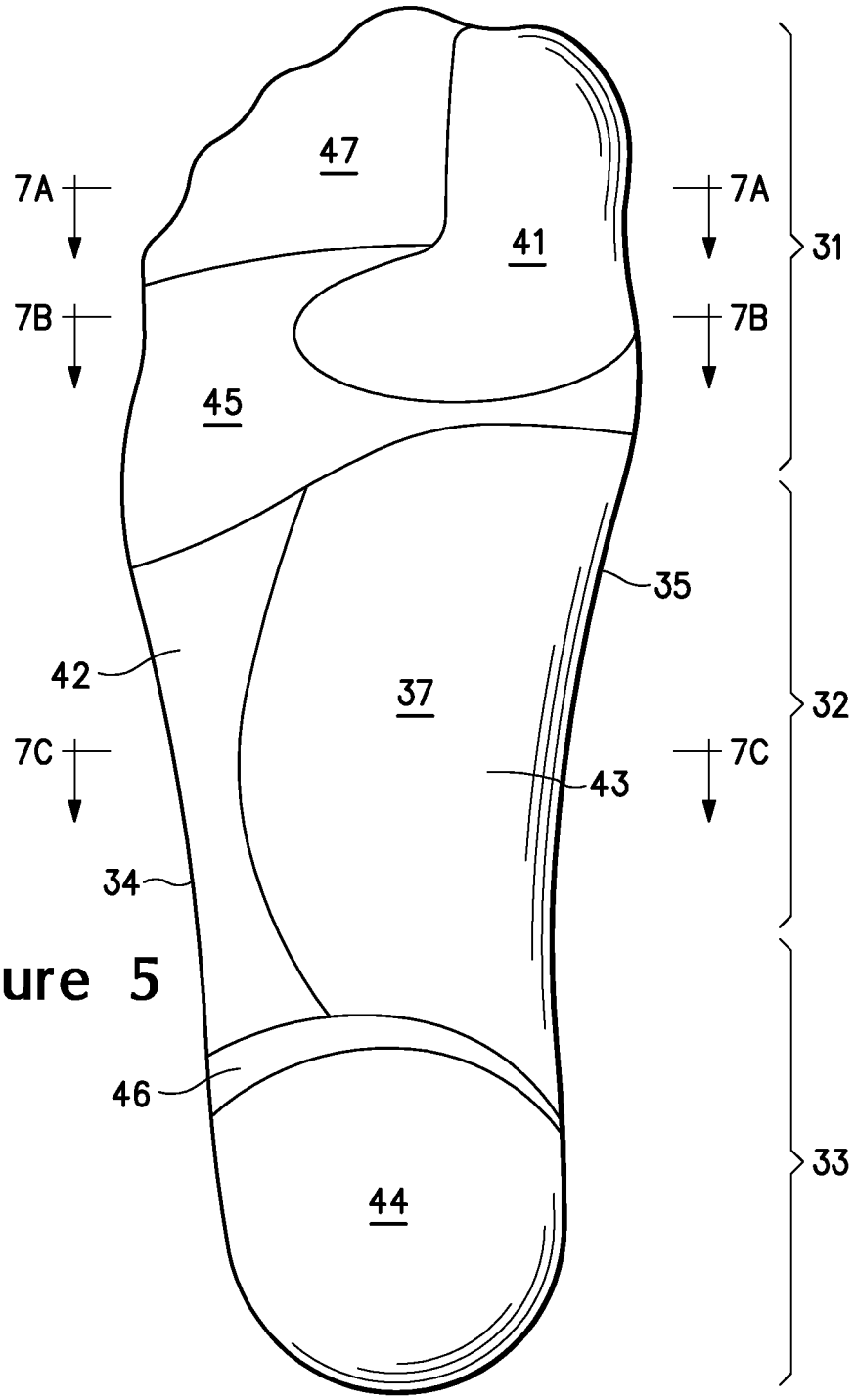
FIG. 5 is a bottom plan view of the article of apparel.
Figure 6:
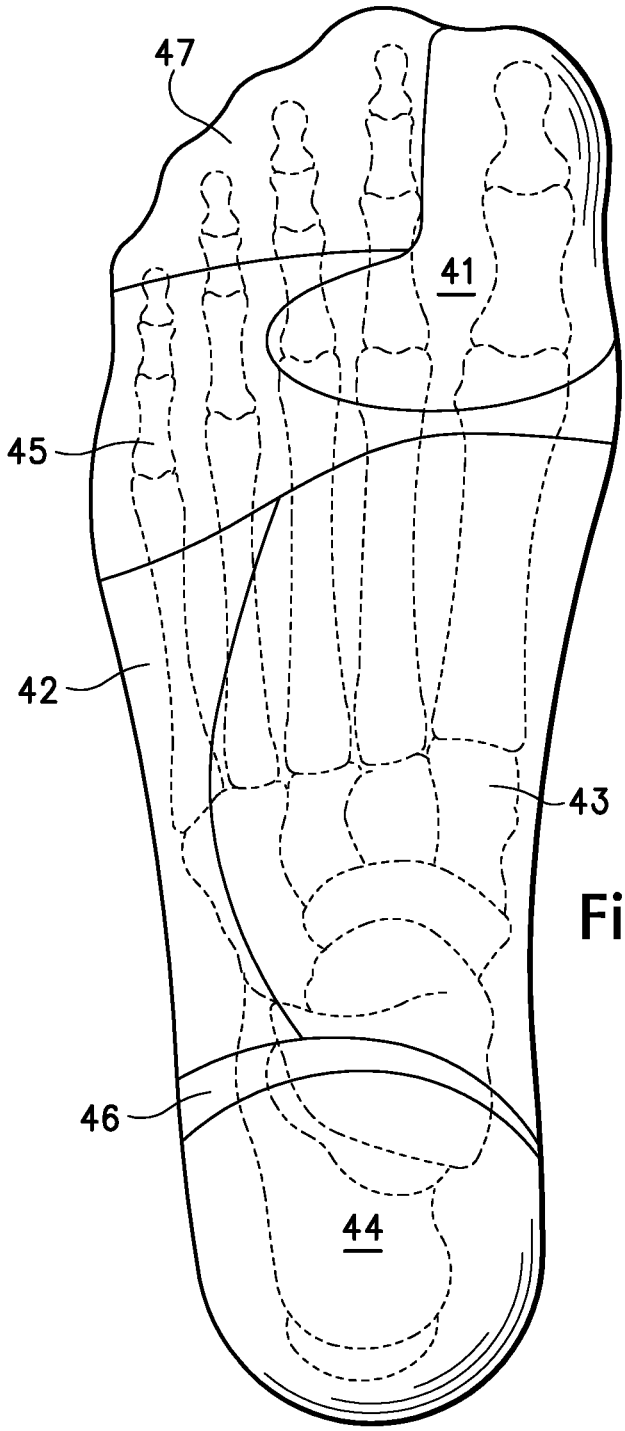
FIG. 6 is a bottom plan view of the article of apparel with bones of a foot superimposed over the apparel.

The following discussion and accompanying figures disclose various articles of apparel with zonal force attenuation properties. During walking, running, and other ambulatory activities, the plantar surface of the foot experiences various compressive forces, and the magnitude of the compressive forces varies throughout the plantar surface. That is, some areas of the plantar surface experience forces with a relatively high magnitude, while other areas of the plantar surface experience forces with a relatively low magnitude. The various articles of apparel disclosed herein incorporate various zones with differing force attenuation properties. The zones, which attenuate forces to differing degrees, are positioned to correspond with areas of the plantar surface that experience different magnitudes of forces.

A sock 10 in accordance with various aspects of the invention is disclosed in FIGS. 1-6. Sock 10 has a generally tubular structure that includes an ankle-receiving portion 20 and a foot-receiving portion 30. When worn by an individual, ankle-receiving portion 20 extends around an ankle of the individual and foot-receiving portion 30 extends around a foot of the individual. In order to provide access to the interior of sock 10, ankle-receiving portion 20 defines an access opening 21 located opposite foot-receiving portion 30. Although sock 10 may have a generally linear configuration, ankle-receiving portion 20 and foot-receiving portion 30 are depicted as being angled with respect to each other to impart an angled configuration to sock 10.

Each of portions 20 and 30 may be formed through a knitting process, for example, from various yarns that stretch or otherwise deform to receive and extend around the ankle and the foot when worn by the individual. Portions 20 and 30 may, therefore, conform to the contours of the ankle and foot so as to extend along the surfaces of the ankle and foot without significant wrinkling or overlapping of the material forming sock 10. When sock 10 is worn by the individual and placed within an article of footwear, therefore, sock 10 provides a comfortable interface between the foot and the footwear.

Foot-receiving portion 30 may be divided into three general regions: a forefoot region 31, an arch region 32, and a heel region 33. Forefoot region 31 generally includes areas of foot-receiving portion 30 corresponding with the toes and the joints connecting metatarsals with phalanges. Arch region 32 generally includes areas of foot-receiving portion 30 corresponding with the arch area of the foot. Similarly, heel region 33 generally includes areas of foot-receiving portion 30 corresponding with rear areas of the foot, including the calcaneus bone. Regions 31-33 are not intended to demarcate precise areas of foot-receiving portion 30. Rather, regions 31-33 are intended to represent general areas of foot-receiving portion 30 to aid in the following discussion.

Foot-receiving portion 30 also includes a lateral side 34, a medial side 35, an upper area 36, and a foot-supporting area 37. Lateral side 34 and medial side 35 extend through each of regions 31-33 and correspond with opposite sides of foot-receiving portion 30. When sock 10 is worn by the individual, lateral side 34 and medial side 35 respectively extend along opposite lateral and medial sides of the foot. Upper area 36 and foot-supporting area 37 also extend through each of regions 31-33 and respectively correspond with an upper area and an opposite lower area of foot-receiving portion 30. When sock 10 is worn by the individual, upper area 36 and foot-supporting area 37 respectively extend along an upper and an opposite lower (i.e., plantar) surface of the foot. As with regions 31-33, sides 34-35 and areas 36-37 are not intended to demarcate precise areas of foot-receiving portion 30. Rather, sides 34-35 and areas 36-37 are intended to represent general areas of foot-receiving portion 30 to aid in the following discussion.

Many conventional socks have a substantially constant thickness throughout the foot-receiving portion. In contrast with these conventional socks, sock 10 includes various zones 41-47 that extend throughout foot-receiving portion 30 and exhibit one of a variety of thicknesses. As discussed above, the plantar surface of the foot experiences various compressive forces during ambulatory activities. Some areas of the plantar surface experience forces with a relatively high magnitude, while other areas of the plantar surface experience forces with a relatively low magnitude. Zones 41-47 exhibit differing force attenuation properties and are positioned to correspond with areas of the plantar surface that experience different magnitudes of forces. Although some of zones 41-47 extend onto one or more of lateral side 34, medial side 35, and upper area 36, the position of zones 41-47 will be primarily discussed in relation to foot-supporting area 37 given that this portion of sock 10 corresponds with the plantar surface of the foot.

Zone 41 is primarily located in forefoot region 31 and has an L-shaped configuration. An area of the zone 41 (i.e., the vertical segment in the L-shaped configuration) extends along a portion of foot-supporting area 37 that is adjacent to medial side 35, and another area of the zone 41 (i.e., the horizontal segment in the L-shaped configuration) extends into a center of foot-supporting area 37. With respect to the foot, zone 41 corresponds in location with a position of a first proximal phalanx and at least a first metacarpo-phalangeal joint of the foot, a second metacarpo-phalangeal joint of the foot, and a third metacarpo-phalangeal joint of the foot.

Zone 42 is primarily located in arch region 32 and has an elongate configuration that extends along a portion of foot-supporting area 37 that is adjacent to lateral side 34. In comparison with ends of zone 42, a central area curves inward to impart a generally hourglass-shaped configuration. With respect to the foot, zone 42 corresponds in location with at least rearward portions of a fifth metatarsal of the foot.

Zone 43 is also primarily located in arch region 32. Whereas zone 42 extends along the portion of foot-supporting area 37 that is adjacent to lateral side 34, zone 43 extends along a portion of foot-supporting area 37 that is adjacent to medial side 33 and also extends onto medial side 33 and upper area 36. That is, zone 43 may wrap around the foot to cover portions of the plantar surface, medial side, and upper surface of the foot, for example. With respect to the foot, portions of zone 43 associated with foot-supporting area 37 correspond in location with first through third metatarsals of the foot. Depending upon the structure of the foot and the manner in which sock 10 fits the foot, either of zones 42 and 43 may correspond in location with portions of a fourth metatarsal.

Zone 44 is primarily located in heel region 33 and is depicted as extending between lateral side 34 and medial side 35 to cover a majority of heel region 33. In alternate structures of sock 10, however, zone 44 may be limited to a portion of foot-supporting area 37 that is adjacent to lateral side 34. With respect to the foot, zone 44 corresponds in location with a calcaneus of the foot.

Zone 45 is primarily located in forefoot region 31, but may also extend into arch region 32. Zone 45 extends around the area of zone 41 corresponding with the horizontal segment in the L-shaped configuration. Accordingly, portions of zone 45 are located forward, rearward, and to a side of zone 41. Zone 45 also extends entirely around foot-receiving portion 30 so as to cover portions of lateral side 34, medial side 35, and upper area 36. With respect to the foot, portions of zone 45 associated with foot-supporting area 37 correspond in location with, for example, a fourth metacarpo-phalangeal joint of the foot and a fifth metacarpo-phalangeal joint of the foot.

Zone 46 is primarily located in heel region 33, but may also extend into arch region 32. Zone 46 extends across foot-supporting area 37 and between lateral side 34 and medial side 35. More particularly, zone 46 is located adjacent to zone 44 and separates zone 44 from each of zones 42 and 43. Zone 47 is primarily located in forefoot region 31 and extends throughout areas of forefoot region 31 not otherwise covered by zones 41 and 45. Portions of zone 47 also extend onto upper area 36 so as to extend over the phalanges of the foot.

Zones 41-47 exhibit differing degrees of force attenuation. More particularly, zones 41 and 44 provide a first degree of force attenuation that is greater than the degree of force attenuation imparted by zones 42-43 and 45-47. Zones 45 and 46 provide a second degree of force attenuation that is less than the first degree of force attenuation. Zone 42 provides a third degree of force attenuation that is less than either of the first degree and the second degree of force attenuation. Finally, zones 43 and 47 provide a fourth degree of force attenuation that is less than all of the first degree, second degree, and third degree of force attenuation. In further configurations of sock 10, additional zones or additional degrees of force attenuation may be utilized.

A variety of configurations in sock 10 may be employed to impart the differences between the force attenuation properties of zones 41-47. As an example, yarns with different yarn counts or yarns formed from different materials may be utilized in zones 41-47 in order to vary the force attenuation properties of zones 41-47. Some of zones 41-47 may be formed to include a terry knit wherein yarns form loops on the surface of foot-receiving portion 30. Variations in the size of the loops or the presence of the loops may be utilized to vary the force attenuation properties of zones 41-47. Variations in the types of knit structures that form zones 41-47 are a further example of configurations may be employed to impart the differences between the force attenuation properties of zones 41-47. Additionally, the number of layers of material in zones 41-47 may be utilized to vary the force attenuation properties.

Some configurations of sock 10 that vary the force attenuation properties of zones 41-47 may have a common thickness. That is, the thickness of zones 41 and 44, which provide the first degree of force attenuation, may be the same as the thickness of zones 43 and 47, which provide the fourth degree of force attenuation. Accordingly, differences in force attenuation may be achieved without differences in the thickness between various zones 41-47. Utilizing yarns with different yarn counts, varying the size of loops in terry knit areas, and varying the number of layers of material in zones 41-47 may each impart, however, differences in the thicknesses of zones 41-47.

Figure 7A:
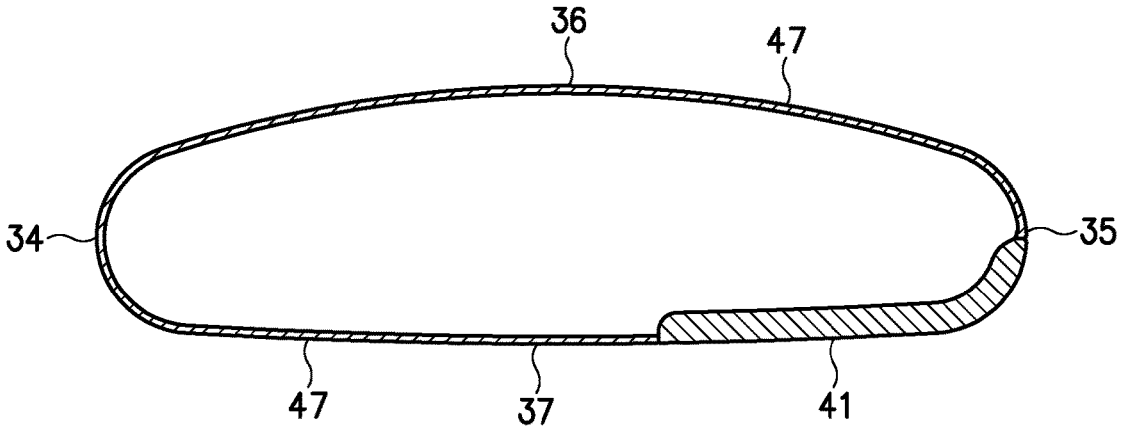
FIGS. 7A-7C are cross-sectional views of the article of apparel, as respectively defined by section lines 7A-7C in FIG. 5.
Figure 7B:
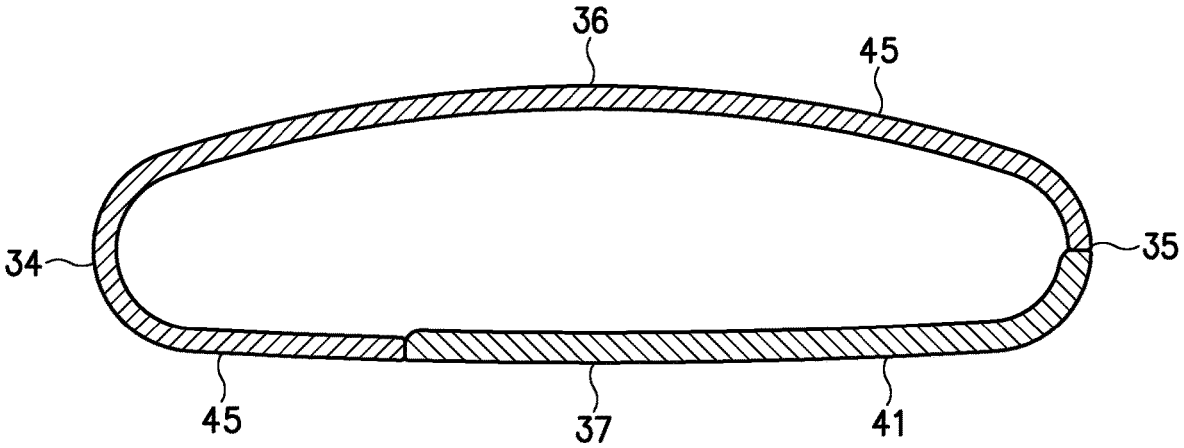
Figure 7C:
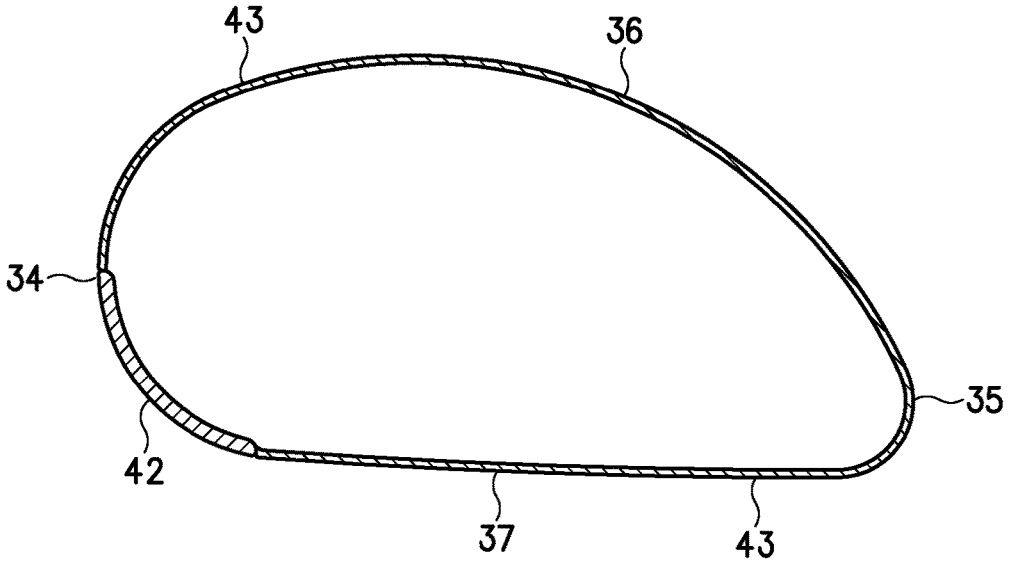

With reference to FIGS. 7A-7C, various cross-sections through sock 10 are depicted to illustrate differences in the thicknesses between some of zones 41-47. FIG. 7A depicts a cross-section through forefoot region 31 to show the relative locations and thicknesses of zones 41 and 47. FIG. 7B depicts another cross-section through forefoot region 31, and behind the cross-section of FIG. 7A, to show the relative locations and thicknesses of zones 41 and 45. Similarly, FIG. 7C depicts a cross-section through arch region 32 to show the relative locations and thicknesses of zones 42 and 43.

Although the positions of zones 41-47 are depicted in the figures and discussed above with specificity, these positions may vary significantly. In some configurations of sock 10, for example, zone 41 may extend under each of the metacarpo-phalangeal joints. Zone 45 may also extend forward to replace portions of zone 47, or the width of zone 42 may increase. Accordingly, the specific positions of zones 41-47 may vary significantly. In order to provide the individual with knowledge of the specific positions for zones 41-47, the yarns associated with various zones 41-47 may vary in color. As noted above, yarns with different yarn counts may be utilized to impart differing force attenuation properties. If each of the yarns exhibit different colors, then zones 41-47 with common force attenuation properties will be formed from yarns with common colors, and those zones 41-47 with different force attenuation properties will be formed from yarns with different colors.

As discussed above, some areas of the plantar surface experience forces with a relatively high magnitude during ambulatory activities, while other areas of the plantar surface experience forces with a relatively low magnitude. Zones 41-47, which attenuate forces to differing degrees, are positioned to correspond with areas of the plantar surface of the foot that experience different magnitudes of forces. That is, zones 41 and 44, which impart the greatest degree of force attenuation, are positioned to correspond with the areas of the plantar surface of the foot that experience forces with a relatively high magnitude. Similarly, each of zones 42-43 and 45-47 are positioned to impart force attenuation that is based upon the magnitude of the forces experienced by corresponding portions of the plantar surface.

In order to determine where zones 41-47 should be positioned and the corresponding force attenuation properties for zones 41-47, a force mapping device may be utilized to obtain data relating to forces upon a plantar surface of the foot during an ambulatory cycle. In general, the force mapping device measures the forces in various areas of the plantar surface to provide data on the areas of the plantar surface of the foot that are subjected to different magnitudes of forces. As an example, the force mapping device may include a matrix of sensors distributed throughout a sock-liner of an article of footwear, and each of the sensors may correspond with a unique location on the plantar surface of the foot. As the individual runs or walks, the sensors will determine forces associated with each location.

The data is then analyzed to determine areas of the plantar surface subjected to forces above a threshold value, for example, during the ambulatory cycle. A sock is then formed to have zones of different thickness, and one of the zones of different thickness is located to correspond with the areas of the plantar surface subjected to the forces above the threshold value. With respect to sock 10, zones 41 and 44 correspond with areas of the plantar surface that experience forces with a relatively high magnitude (i.e., above the threshold). Zones 42 and 45-46 are formed to correspond with areas of the plantar surface experiencing intermediate degrees of force, and zones 43 and 47 are formed to correspond with areas of the plantar surface experiencing lesser forces.

Sock 10 has a configuration that is suitable for a right foot of the individual. Another sock having a configuration that is suitable for a left foot of the individual may be formed to have a similar structure, but wherein zones 41-47 are arranged in an opposite (i.e., mirror image) configuration. In order to provide the individual with knowledge regarding which foot sock 10 is suitable for, an "R" or other identifier may be knitted into the structure of sock 10 to indicate that sock 10 is intended for the right foot. That is, socks within the scope of the present invention may include identifiers to ensure that the socks are utilized with the proper foot of the individual.

A benefit to forming sock 10 with zones 41-47 relates to the resulting mass of sock 10. Whereas zones 41 and 44 are relatively thick, zones 43 and 47 are relatively thin. In comparison with zones 41 and 44, the mass of zones 43 and 47 per unit area is decreased. In areas where lesser force attenuation is required, therefore, zones with a lesser mass per unit area may be utilized, thereby decreasing the overall mass of sock 10. The overall decrease in mass and thickness may also result in enhanced moisture management properties and enhanced fit when located within a shoe.

Sock 10 is formed from a textile material. Textiles generally fall into two categories. The first category includes textiles produced directly from webs of fibers or filaments by bonding, fusing, or interlocking to construct non-woven fabrics and felts. The second category includes textiles formed through a mechanical manipulation of yarn. The various techniques for mechanically-manipulating yarn into a textile include interweaving, intertwining and twisting, and interlooping. Interweaving is the intersection of two yarns that cross and interweave at substantially right angles to each other. The yarns utilized in interweaving are conventionally referred to as warp and weft. Intertwining and twisting encompasses procedures such as braiding and knotting where yarns intertwine with each other to form a textile. Interlooping involves the formation of a plurality of columns of intermeshed loops, with knitting being the most common method of interlooping.

Although any of the textile types and techniques for mechanically-manipulating yarn into a textile, as discussed above, are suitable for sock 10, a circular knitting process provides a specific example of a suitable technique that produces a seamless textile having a tubular structure. In a circular knitting process, a circular knitting machine operates in a circular mode to form a tubular structure. In areas where the tubular structure has an angled configuration or the tube narrows to a closed end, the circular knitting machine may operate in a reciprocating mode. In the manufacture of sock 10, a substantial portion of ankle-receiving portion 20 may be formed with a circular knitting machine in the circular mode. In the transition between ankle-receiving portion 20 and foot-receiving portion 30, the circular knitting machine may operate in the reciprocating mode to form portions of heel region 33. In forming arch region 32, the circular knitting machine will return to the circular mode. Finally, in forming forefoot region 31, and particularly the narrow forward area of forefoot region 31, the circular knitting operates in the reciprocating mode. Forward areas of forefoot region 31 include zones 41 and 47, and zone 41 exhibits a greater thickness than zone 47 due to, for example, different yarn counts in the yarns associated with zones 41 and 47. When in the reciprocating mode, therefore, the circular knitting machine may make two zones of different thickness, whether in forefoot region 31 or heel region 33.

Figure 8:
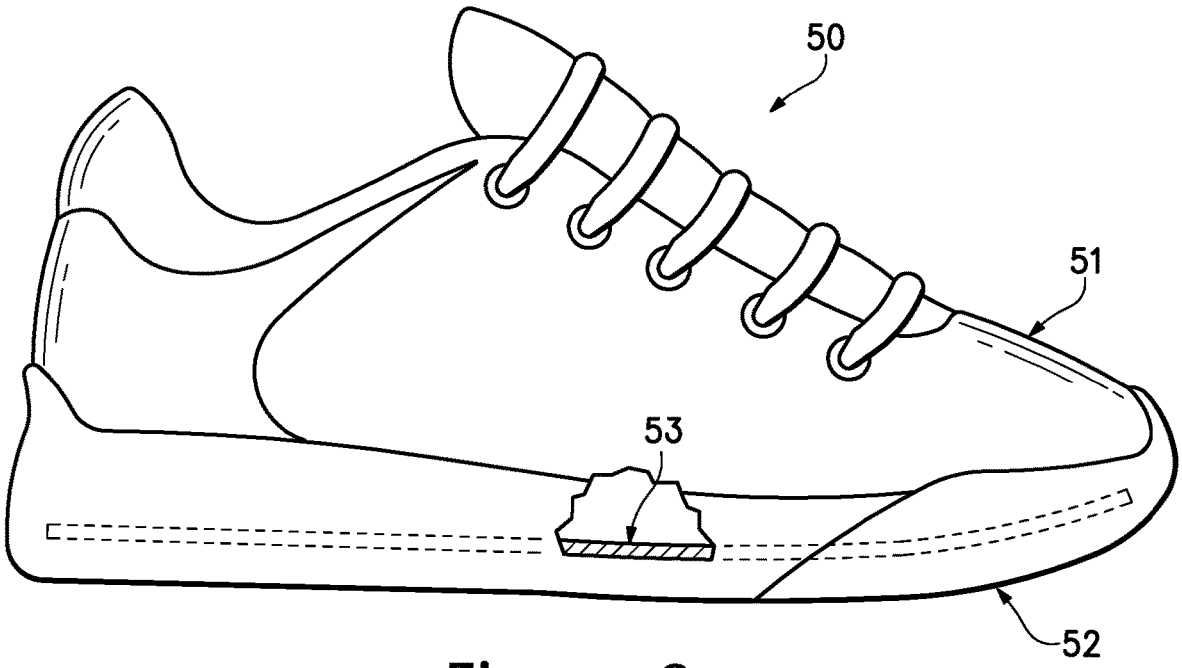
FIG. 8 is a side elevational view of an article of apparel in accordance with aspects of the invention.
Figure 9:
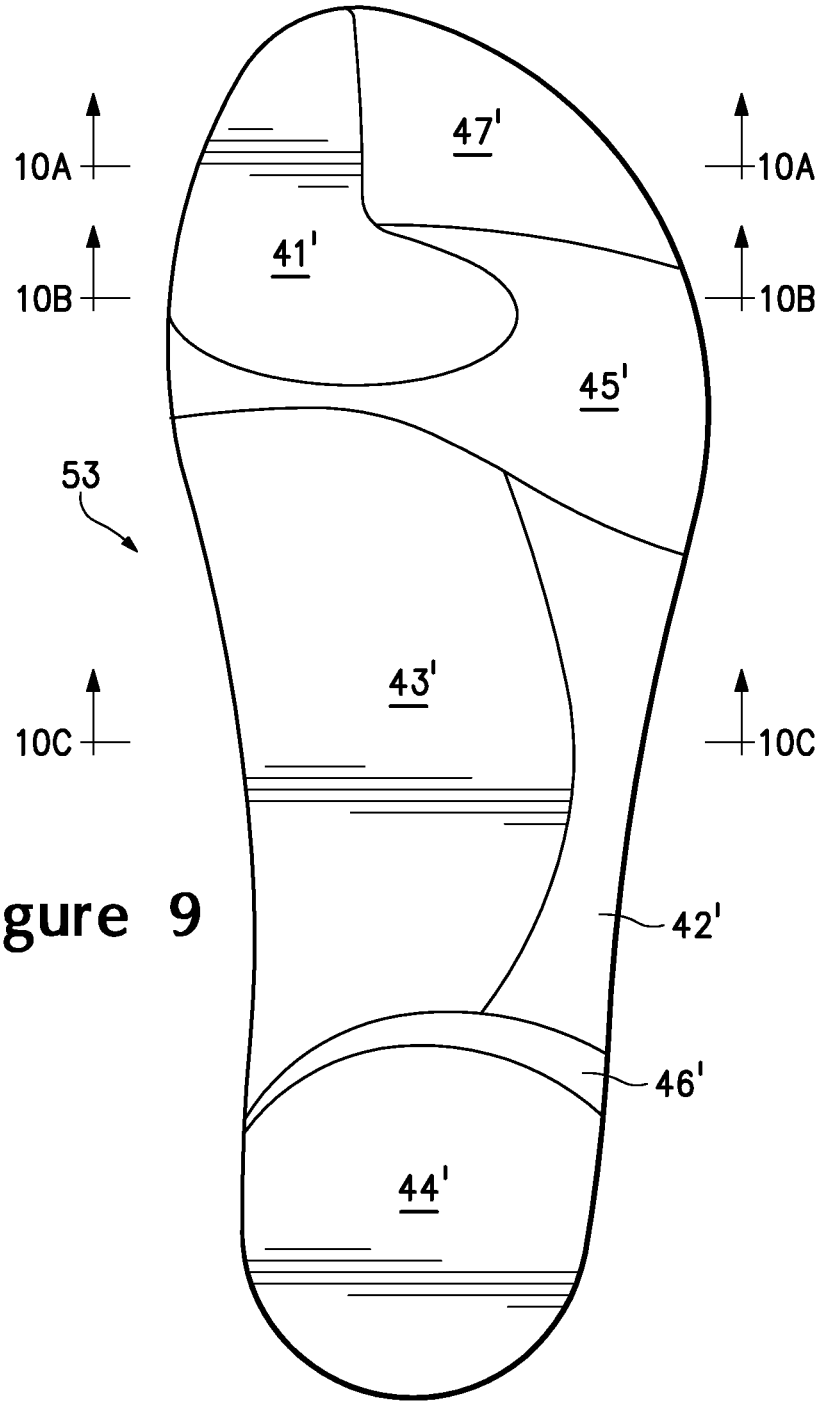
FIG. 9 is a top plan view of a sockliner of the article of apparel.
Figure 10A:
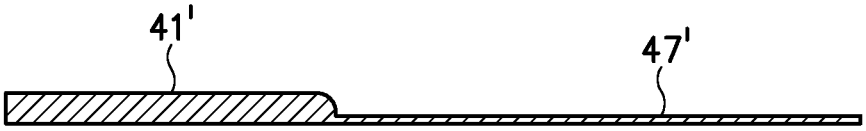
FIGS. 10A-10C are cross-sectional views of the sockliner, as respectively defined by section lines 10A-10C in FIG. 9.
Figure 10B:
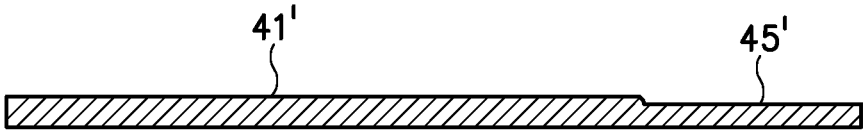
Figure 10C:
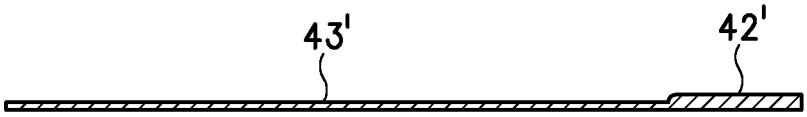

Sock 10 provides an example of one type of apparel with zonal force attenuation properties. With reference to FIG. 8, an article of footwear 50 having an upper 51 and a sole structure 52 is disclosed. Each of upper 51 and sole structure 52 may have a generally conventional configuration. In contrast with a conventional article of footwear, however, footwear 50 incorporates a sockliner 53 that also has zonal force attenuation properties. With reference to FIG. 9, an upper surface of sockliner 53, which provides a foot-supporting surface for footwear 10, includes a plurality of zones 41'-47' that correspond in position to zones 41-47 of sock 10. As depicted in FIGS. 10A-10C, zones 41-47 exhibit differing thicknesses that impart different degrees of force attenuation. Accordingly, concepts related to sock 10, as discussed above, may also be applied to other articles of apparel, including footwear.

The invention is disclosed above and in the accompanying drawings with reference to a variety of embodiments. The purpose served by the disclosure, however, is to provide an example of the various features and concepts related to aspects of the invention, not to limit the scope of aspects of the invention. One skilled in the relevant art will recognize that numerous variations and modifications may be made to the embodiments described above without departing from the scope of the invention, as defined by the appended claims.

That which is claimed is:

1. A method of manufacturing an article for receiving a foot, the article comprising a foot-supporting area for extending adjacent to a plantar surface of a foot, the method comprising steps of:

forming a heel zone of the article with a circular knitting machine in a reciprocating mode;

forming a midfoot zone of the article with the circular knitting machine in a circular mode; and forming a forefoot zone of the article with the circular knitting machine in the reciprocating mode, the forefoot zone having a first forefoot area positioned on a medial side of the foot-supporting area, a first portion of the first forefoot area extending along a medial side of the foot-supporting area, and a second portion of the first forefoot area extending into a center of the foot-supporting area and terminating in the center of the foot supporting area, the first forefoot area having a first thickness, each of a lateral edge and a rear edge of the first forefoot area abutting edges of a second forefoot area having a thickness different than the first thickness, and an entire continuous outer periphery of the first forefoot area having an L shaped configuration, the first forefoot area and the second forefoot area being formed with the circular knitting machine in the reciprocating mode.

2. The method recited in claim 1, wherein the first forefoot area has a terry-knit structure and the second forefoot area has a non-terry-knit structure.

3. The method recited in claim 1, wherein the first forefoot area has a terry-knit structure with loops of a first height, and the second forefoot area has a terry-knit structure with loops of a second height.

4. The method recited in claim 1, wherein the first forefoot area and the second forefoot area are formed of yarns with different yarn counts.

5. The method recited in claim 1, wherein the heel zone comprises a first heel area located on a lateral side of the heel zone, and a second heel area is located on a medial side of the heel zone; the first heel area being thicker than the second heel area.

6. The method recited in claim 1, wherein the heel zone comprises a first heel area is-located on a medial side of the forefoot zone, and a second heel area located on a lateral side of the forefoot zone; the first heel area being thicker than the second heel area.

7. The method recited in claim 1, wherein the first forefoot area corresponds in location with a position of a first proximal phalanx and at least a first metacarpo-phalangeal joint, a second metacarpo-phalangeal joint, a third metacarpo-phalangeal joint of the foot.

8. The method of claim 1 wherein the midfoot zone comprises an arch region having (a) a first arch area positioned on a lateral side of the foot-supporting area, the first arch area having a second thickness that is less than the first thickness and (b) a second arch area positioned on the medial side of the foot-supporting area, the second arch area having a third thickness that is less than the second thickness.

9. The method recited in claim 8, wherein yarns with different yarn counts are utilized for each of the first arch area and second arch area.

10. The method recited in claim 8, wherein yarns with different yarn counts and colors are utilized for each of the first arch area and second arch area.

11. The method recited in claim 8, wherein the first arch area and the second arch area are formed from terry knit structures with different loop heights.

* * * * *